United States Patent [19]

Warncke

[11] 4,403,608

[45] Sep. 13, 1983

[54] PRESSURE GAS VENTILATED PROTECTIVE SUIT AND METHOD OF OPERATING THE SUIT

[75] Inventor: Ernst Warncke, Lübeck, Fed. Rep. of Germany

[73] Assignee: Drägerwerk Aktiengesellschaft, Fed. Rep. of Germany

[21] Appl. No.: 248,495

[22] Filed: Mar. 27, 1981

[30] Foreign Application Priority Data

Apr. 23, 1980 [DE] Fed. Rep. of Germany ..... 3015584

[51] Int. Cl.[3] ..... A62B 7/04

[52] U.S. Cl. ..... 128/201.28; 128/201.29; 2/2.1 A

[58] Field of Search ..... 128/201.22, 201.23, 128/201.24, 201.25, 201.27, 201.28, 201.29; 2/2.1 A

[56] References Cited

U.S. PATENT DOCUMENTS

| | | | |
|---|---|---|---|
| 2,335,873 | 12/1943 | Morse, Sr. | 128/201.28 |
| 2,404,567 | 7/1946 | Colley | 128/202.11 |
| 2,573,414 | 10/1951 | Dunn | 128/201.29 |
| 2,954,562 | 10/1960 | Krupp | 2/2.1 A |

FOREIGN PATENT DOCUMENTS

| | | | |
|---|---|---|---|
| 259934 | 5/1913 | Fed. Rep. of Germany | 128/201.27 |

*Primary Examiner*—Henry J. Recla
*Attorney, Agent, or Firm*—McGlew and Tuttle

[57] ABSTRACT

A pressure gas ventilated pressure suit comprises a suit adapted to cover a person which includes a head portion with a face encompassing part which defines a breathing space in front of the person's face and which also includes a body portion defining a pressure space around the person's body and parts of the person's head which is separate from the breathing space. A connection is established between the breathing space and the pressure space through a check valve which permits inhaling of the air found in the pressure space through the breathing space to the wearer. The pressurized breathing gas is connected to discharge gas into the pressure space to maintain it at a predetermined pressure which advantageously provides an inflation of the body portion of the suit. During breathing the wearer inhales in the breathing space and pulls in some of the air from the pressure space through the check valve. The air is exhaled through an exhaling valve connected into the breathing space. The suit advantageously provides a device for adjusting the pressure in the body portion through the regulation of a pressure regulating valve which is connected to the discharge of a compressed air tank.

13 Claims, 2 Drawing Figures

PRESSURE GAS VENTILATED PROTECTIVE SUIT AND METHOD OF OPERATING THE SUIT

FIELD AND BACKGROUND OF THE INVENTION

This invention relates in general to protective suits and in particular to a new and useful pressure gas ventilated suit which includes a body portion which is under separate pressure and which is connected through a breathing space of a head portion through an inhaling valve.

Protection against contaminated gases or gases with concentrations which lead to skin injuries, can only be effected with protective suits which seal the body hermetically from the ambient atmosphere. Protection against radioactive gases, as they appear, e.g. in nuclear reactors, nuclear power plants and isotope laboratories, requires protective suits which prevent the body of the protective suit wearer from coming in contact with radioactive dusts or gases or radiation. It cannot be prevented that radioactive particles will be deposited on the outer surface of the suit. The radiation hazard for the wearer decreases with the distance of the suit material from body surface. The protective suit should therefore not bear tightly on the body, but the distance between the suit wearer and the suit cover should be as great as possible.

A known protective suit seals at the arms and legs or on the gloves and boots by elastic cuffs. The hood seals a gas mask.

The user carries on his back a compressed air tank apparatus. The breathing air is supplied over the usual dosing device through an inhaling hose to the gas mask, and thus to the wearer. The exhaled air is introduced into the protective suit from the mask through a hose into which a water separator is connected. It flushes the protective suit and leaves it again through leaks provided for this purpose. These leaks can be special check valves.

The resulting slight excess pressure inflates the suit only incompletely. This is particularly undefined in movements of the suit wearer and underpressures are not possible. A disadvantage is also the high temperature of 37° C. of the exhaled air. The compressed tank apparatus, the breathing air lines, and the water separator outside the suit are extremely annoying and are exposed directly to contamination (German Utility Model No. 17 44 688).

Another known protective suit ventilated with pressure gas also covers the compressed air respirator. But the protective suit can also be supplied directly from the outside through a compressed air hose. In both cases the compressed air is split into a first partial current flowing through an accordion hose to the oxygen mask, and into a second partial current to a jet pump.

The first partial current is inhaled as breathing air, controlled over a lung demand valve and exhaled again through an exhaling valve on the mask into the protective suit. The second partial current drives the jet pump, which takes in its supply air over a dry cartridge from the interior of the suit, hence also the exhaled air, and distributes through lines in the protective suit. Outlet valves in the protective suit conduct an amount of flushed air corresponding to the amount of exhaled air constantly to the outside. The temperature of the air exhaled into the suit increases the inside temperature on the protective suit. The compressed air used for the operation of the jet pump is lost for breathing. It shortens the possible time of use in an operation with compressed air cylinders. (German Pat. No. 12 41 713).

The invention provides a protective suit with a respirator, which can be inflated up to a selected pressure, uses no additional breathing air for ventilation under optimum climatic conditions for the wearer, and has a simple mechanical design.

The inventive pressure suit provides a suit which is adapted to cover a person and includes a head portion with a face encompassing part which defines a breathing space in front of the face of the wearer and a body portion which defines a pressure space separate from the breathing space. A connection is provided between the breathing space and the pressure space and a check valve in this connection permits flow of air from the pressure space into the breathing space during inhaling of the wearer can also discharge air back into the breathing space and out through an exhaling valve.

The protective suit according to the invention contains an air supply from the compressed air apparatus of the respirator, or directly from a coupled compressed air line of a central supply. The air enters the free space of the protective suit over the pressure regulating valve, practically a positive pressure demand valve, and inflates the suit up to the desired excess pressures. The inhaling air is taken by the wearer from an inflated free space in the suit through a check valve between the suit body and a head mask position. Hot exhaled air from the user is conducted directly into the atmosphere. The pressure regulating valve controls the air until it is adapted again to the provided excess pressure. Breathing air which is withdrawn is cooled by expansion and in this way conducted over the body surface. With the increased breathing air throughput under heavy stresses of the wearer, the cooling is automatically improved. The air guiding system leads to a very favorable use of the breathing air supply. The protective suit, hence the free space in the suit body only has to be filled once. Subsequently only so much is used for breathing as would correspond to direct withdrawal from a pressure tank of oxygen. At the end of the use, the free space can be breathed out until the excess pressure in the suit is reduced to the normal pressure. The breathing air supply is thus fully utilized.

Accordingly, it is an object of the invention to provide an improved pressure gas ventilated pressure suit which includes a separate head and body portion, the head portion defining a breathing space in front of the wearer and the body portion defined a pressure space which is maintained under pressure by gas from a pressure gas source associated with the suit and which further includes a connection between the pressure space and the breathing space to permit air to flow from the pressure space into the breathing space during inhaling by the wearer.

A further object of the invention is to provide a method of operating a protective suit which comprises pressurizing a body portion of the suit so that it is maintained in a slightly inflated condition and directly a portion of the air from the pressure portion of the suit into a breathing space in a head portion in front of the wearer's face so that the wearer may inhale this air.

A further object of the invention is to provide a pressure gas ventilated pressure suit which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
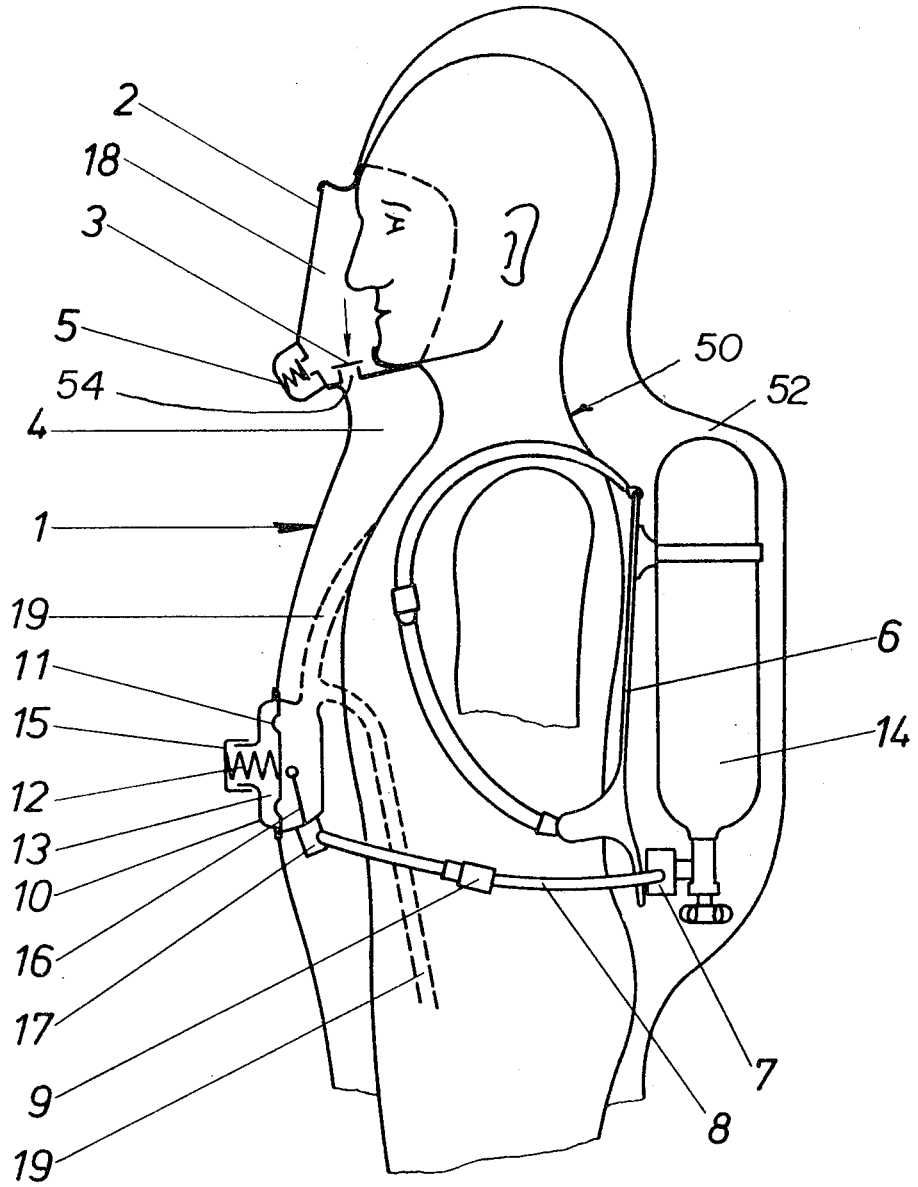
FIG. 1 is a schematic partial sectional view of a wearer having a protective suit constructed in accordance with the invention.

Referring to the drawings in particular, the invention embodied therein comprises a pressure gas ventilated pressure suit generally designated 1 adapted to cover a person or a wearer 50 and which includes a head portion generally designated 2 which defines a breathing space 18 in front of the face of the wearer and a body portion which defines a pressure space 4 separate from the breathing space and around the body of a wearer including a portion of the head portion in the embodiment shown. A connection 54 is provided between the pressure space 4 and the breathing space 18 and check valve means 3 are located in this connection which permits flow from the pressure space to the breathing space upon there being a predetermined pressure differential between these two spaces. This permits normal inhaling by the wearer from the air in the breathing space and drawing in of additional air from the pressure space. Air is exhaled from the breathing space through an exhaling valve 5.

The protective suit 1 used by the wearer 50 is provided with a full oxygen head mask 2. The full oxygen head mask 2 has breathing space 18 which is connected through an inhaling valve 3 with a pressure space or free space 4 remaining around the wearer's body of a body portion 52 of the suit 1. The valve 3 permits the withdrawal of inhaling air from the free space 4 into a breathing air space 18 in the head mask 2. The exhaled air is conducted from the wearer 50 to the outside over an exhaling valve 5, with which the full head mask 2 is likewise equipped. The wearer 50 carries respirator 6, a compressed air respirator, inside protective suit 1 on his back. The breathing air is conducted from a pressure reducer 7 and a hose line 8 with a coupling 9 to a pressure regulating valve 10 arranged in a wall of the suit 52. The pressure regulating valve 10 corresponds in its design to the known positive pressure demand valves of known respirator apparatus. An essential part is a diaphragm 11, which is loaded by a spring 12. Spring space 13 is in communication with the ambient atmosphere.

With compressed air tank 14 open, an excess pressure builds up in free space 4 which counterbalances the pressure of spring 12 on diaphragm 11, which can be adjusted through a spring cover 15. The control is effected by a control lever 16 of a compressed air valve 17 moved by diaphragm 11.

Inhaling valve 3 and exhaling valve 5 are together so spring-loaded that they counterbalance at least the excess pressure in the suit building up over pressure regulating valve 10. Preferably, however, exhaling valve 5 opens only at a pressure of 4 mbar in the free space 4. The higher pressure prevents flow-off losses when free space 4 is temporarily reduced in size by movement of the wearer. The inhaling volume is taken from free space 4 through the inhaling valve 3. The reduction of the excess pressure in the suit resulting from the withdrawal of breathing gas is compensated by the pressure regulating valve 10 supplied with air from compressed air tank 14. The expanding air is cool and has a corresponding refreshing effect in the interior of the suit.

During the following exhalation, inhaling valve 3 closes and the hot exhaled air is led off directly to the outside through exhaling valve 5. The increased opening pressure of exhaling valve 5 is hardly noticed by the wearer because the excess pressure in the suit propagates over the slightly spring loaded "(in direction of the arrow)" inhaling valve 3 practically into mask space 18 after the inhaling phase is completed. The wearer only has to overcome during the exhalation phase the pressure difference formed between the excess suit pressure in free space 4 and mask space 18.

With a greater spring load on inhaling valve 3, the excess suit pressure cannot propagate from free space 4 into mask air space 18. In this case a simple check valve suffices as an exhaling valve 5, so that the wearer does not have to overcome an additional exhaling resistance.

Spring cover 15, in addition to changing the force of spring 12, can also act as a switch with which the action of spring 12 on diaphragm 11 is cancelled. The excess pressure in free space 4 is thus completely eliminated. This is of advantage when putting on and taking off protective suit 1, when the wearer must pass through narrow cross sections. This is not possible with an inflated suit.

From pressure regulating valve 10, distributor lines 19 and 19' extend into the respective arms and legs of protective suit 1. The expanding air flows then from there over the entire body to inhaling valve 3, cooling it on its way.

Figure 2:
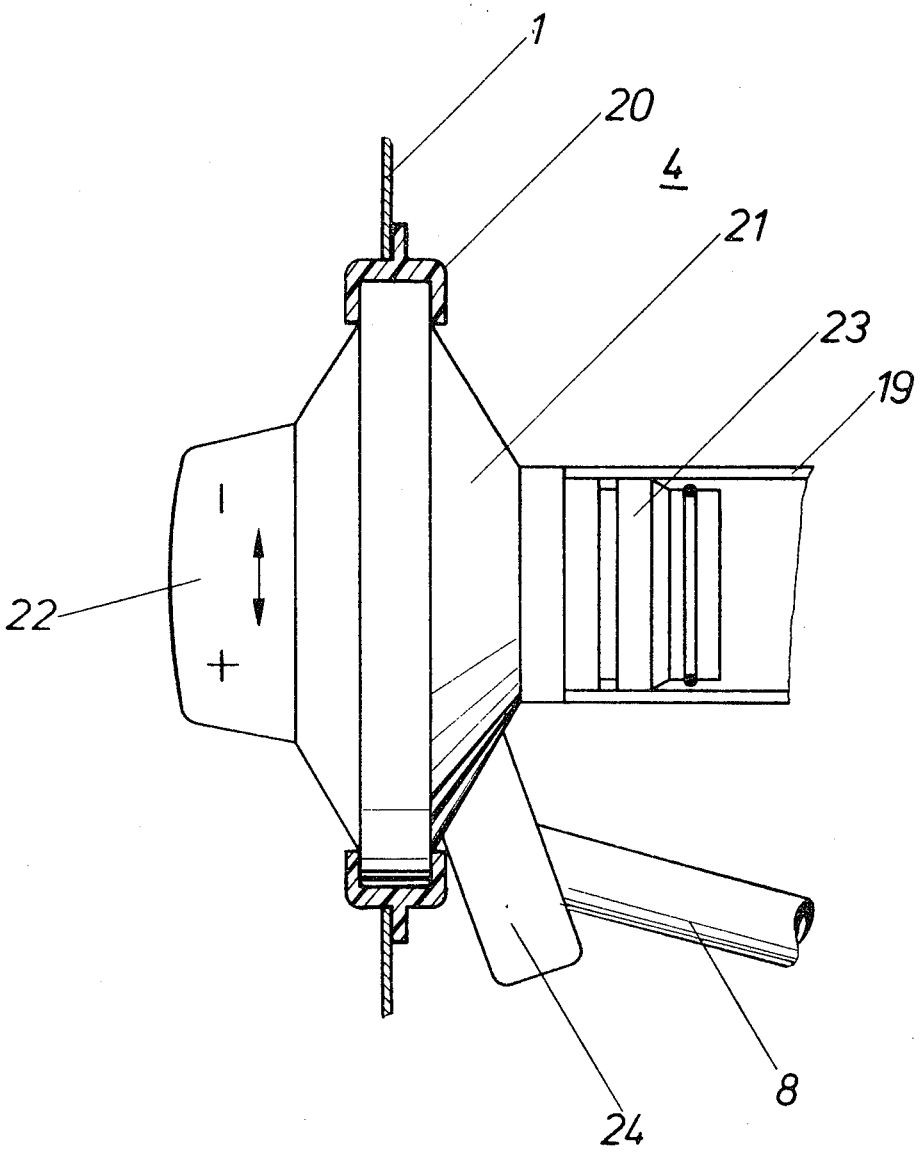
FIG. 2 is an enlarged detailed view of another embodiment of a positive pressure demand valve for use with the suit shown in FIG. 1.

FIG. 2 shows in a cuff 20 of the suit 1 the use of a normal positive pressure demand valve 21 instead of pressure regulating valve 10 (of FIG. 1). Valve 21 is mounted on the suit with a switching device 22 provided outside the suit. Mask connection 24 of positive pressure demand valve 21 extends in free space 4 of the suit. The connection of the hose line 8 from the pressure reducer 7 (which is shown in FIG. 1) is effected at the mask connection 24. The connection of distributor line 19 to the valve 21 is made at a mask connection 23. In this way, a positive pressure demand valve can be used instead of pressure regulating valve 10 for ventilating the suit and for keeping the pressure therein constant.

While a specific embodiment of the invention has been shown and described in detail to illustrate the application of the principles of the invention, it will be understood that the invention may be embodied otherwise without departing from such principles.

What is claimed is:

1. A pressure gas ventilated pressure suit comprising a suit adapted to cover a person including a head portion with a face encompassing part defining a breathing space in front of the face of the wearer and a body portion defining a pressure space separate from said breathing space, a connection between said pressure space and said breathing space, check valve means in said connection permitting flow of air from said pressure space to said breathing space upon there being a predetermined pressure differential between said spaces, exhaling valve passage means connected from said breathing space to the outside of said suit, and pressure gas supply means associated with said suit supplying gas under pressure to said pressure space to maintain it at a predetermined pressure.

2. A pressure gas ventilated pressure suit according to claim 1, wherein said check valve means comprises an inhaling valve, means biasing said valve to a closed position being set to open upon exceeding of a predetermined overpressure in said pressure space.

3. A pressure gas ventilated pressure suit according to claim 1, wherein said pressure gas supply means includes a pressure tank supply of breathing gas connected into said pressure space and a pressure regulating valve in the connection from said pressure gas tank to said pressure space, and means for regulating said pressure regulating valve.

4. A pressure gas ventilated pressure suit according to claim 3, wherein said means for regulating said pressure regulating valve comprises biased diaphragm means for supplying gas from said tank to said space, and a rotatable spring cover engaged with said diaphragm means which may be rotated to adjust said diaphragm means and thus adjust pressure in said pressure space.

5. A pressure gas ventilated suit according to claim 4, wherein said connection of said pressure gas supply to said pressure space includes a plurality of distributor lines inside said protective suit connected to said pressure regulating valve.

6. A pressure gas ventilated pressure suit according to claim 5, wherein said distributor lines includes a central connecting line leading to the front of said suit, said suit having a wall portion in the front, said pressure regulating valve being mounted on said suit wall portion.

7. A pressure gas ventilated pressure suit according to claim 1, wherein said pressure gas supply means comprises a pressure gas tank.

8. A pressure gas ventilating pressure suit according to claim 1, wherein said supply means comprises a respirator connected to said pressure space.

9. A pressure gas ventilated suit according to claim 1, wherein said pressure gas supply means includes a pressure gas tank, a regulating valve connected between said tank and said pressure space and including a cuff portion which is mounted to a wall of said suit body portion for supporting said regulating valve on said suit.

10. A method of operating a protective suit having a mask portion adapted to overlie a person's head and a body portion overlying a person's body using a breathing gas supply associated with the suit, comprising delivering the gas from the gas supply to the body portion of the suit, regulating the pressure in the body portion of the suit to maintain it at an over pressure substantially to inflate the body portion, allowing the gas in the body portion to pass into the head portion for breathing by the wearer at a predetermined inhaling pressure in the head portion and permitting the wearer to exhale air into the breathing space and discharge it into the atmosphere.

11. A method according to claim 10, wherein the air which is delivered from the pressure space to the breathing space in the head portion is regulated by a pressure controlled inhaling valve.

12. A method according to claim 10, including regulating the exhaling pressure from the breathing space to the atmosphere so that the breathing space is vented at a predetermined pressure.

13. A method according to claim 10, including regulating the pressure in the pressure space so that the pressure falls off therein for positioning the suit on the wearer.

* * * * *